United States Patent [19]

Narwid et al.

[11] 3,937,379

[45] Feb. 10, 1976

[54] SHEET MATERIAL FEED APPARATUS

[76] Inventors: Bernard V. Narwid, 15 York Road, North Arlington, N.J. 07032; Martin W. Fellers, 122 Hobart Ave., Short Hills, N.J. 07078

[22] Filed: Sept. 6, 1974

[21] Appl. No.: 503,753

[52] U.S. Cl. ..... 226/150; 226/159; 226/162

[51] Int. Cl.[2] ..... B65H 17/36

[58] Field of Search ..... 226/150, 158, 159, 162

[56] References Cited

UNITED STATES PATENTS

| | | | |
|---|---|---|---|
| 2,586,536 | 2/1952 | Haller | 226/162 X |
| 3,410,161 | 11/1968 | Roch | 226/162 X |
| 3,580,449 | 5/1971 | Chaban | 226/162 X |
| 3,583,268 | 6/1971 | Scribner | 226/162 X |
| 3,643,845 | 2/1972 | Phillips | 226/162 X |

*Primary Examiner*—Richard A. Schacher
*Attorney, Agent, or Firm*—John B. Armentrout

[57] ABSTRACT

Apparatus wherein sheet material is longitudinally step-advanced by alternately being gripped and released in a guide path by a reciprocative gripper, and alternately released and gripped in a gripping station, the sheet material being restrained against buckling from the guide path by guide means adjacent to both of opposite faces of the sheet material, and the guide means enabling the reciprocative gripper gripping the sheet material in the guide path to be operated for effecting a forward feeding stroke having the sheet material released in the gripping station, and subsequently a backward stroke, throughout which latter stroke the reciprocative gripper is in a released condition with reference to the sheet material and the latter is gripped in the gripping station.

11 Claims, 14 Drawing Figures

SHEET MATERIAL FEED APPARATUS

The present invention relates to sheet material feed apparatus, and is more particularly concerned with improvements in apparatus and controls for intermittently step-feeding sheet material.

A number of devices heretofore have been provided for step-feeding sheet material, and have been controlled such as for serving a machine which subjects each of successive portions of the sheet material received to one or more working operations. Among the heretofore known step-feed devices are those which include reciprocative step-feed and gripper means wherein a gripper alternately grips and releases sheet material, for the sheet material, when gripped, to advance in stroke with the gripper, the gripper when released being retracted by return stroke in preparation for once more gripping the sheet material and being moved forward with the sheet material in a further feeding stroke.

Problems arise in connection with certain of the reciprocative step-feed devices in the prior art in view of the fact that those devices lack adequate guidance for the sheet material in the environs of where the sheet material receives intermittent gripping and release action in the device, considering too that the reciprocative step-feed and gripper means at times is moving with the sheet material and at other times is moving relatively to the sheet material under conditions where the latter may seek bad alignment as by buckling immediately outside the gripper. For still other reasons than the latter, reciprocative sheet-feed prior art devices in certain instances have fallen short of being satisfactory either or both from the standpoint of construction or operation, and it has become desirable to lend improvements to overcome difficulties in that respect.

An object of the present invention accordingly is the provision of practical and reliable reciprocative feed apparatus for step-feeding sheet material, such as metal strip, wherein the sheet material is easily and accurately controlled to have the amount of sheet material issued during a feed step reliably be substantially the same as the amount of sheet material to be issued in each of a number of sequential feed steps which are to follow on continued operation of the apparatus.

Another object of this invention is the provision of apparatus of the character indicated wherein the sheet material to be fed is guided adjacent to opposite facial sides of the sheet material to extend in a path formed in the apparatus in a region including locations wherein gripping, releasing and step-feeding actions occur, and thus to have the sheet material as guided be available along that same course when gripping, releasing and step-feeding actions are repeated in an ensuing cycle of operation of the apparatus.

A further object of this invention is to provide apparatus of the character indicated in which reciprocative feed mechanism is adapted to grip and release the sheet material, and which feed mechanism in locally gripping the sheet material projects into the guide path for step-advancing the sheet material during forward stroke, having the sheet material meanwhile confined to the guide path, and and which feed mechanism after the conclusion of forward stroke is operative to release the sheet material in the guide path and travel relatively to the sheet material in a return stroke.

Other objects herein in part will be obvious and in part pointed out more fully hereinafter.

In accordance with the present invention, feed apparatus is provided for step-feeding sheet, such as strip made of metal or of any other suitable material, which apparatus closely guidedly confines the sheet material on opposite facial sides of the latter for restricting the material to a guide path between first releasable clamp means and step-feed and second releasable clamp means in the apparatus, having the step-feed and second releasable clamp means effective in the guide path for gripping and releasing the material in accordance with the first releasable clamp means being released from the material while the step-feed and second releasable clamp means, gripping the material, is operated to feed the material, and subsequently to have the step-feed and second releasable clamp means operated while released from the material and having the first releasable clamp means gripping the material until after the step-feed and second releasable clamp means is disposed for another step-feed operation of the apparatus to ensue. In preferred embodiments, the first releasable clamp means is located to act in the guide path on the sheet material output side of the sheet-feed and second releasable clamp means for the latter to exercise a forward push-feeding action upon the sheet material in step-feeding the same to the first releasable clamp means with the sheet material meanwhile being closely confined to follow a guide path extending between the step-feed and second releasable clamp means and the first releasable clamp means, and for the sheet material to be gripped and released by those means and step-advanced by operation of the step-feed and second releasable clamp means while the sheet material extends confined to the guide path between the step-feed and second releasable clamp means and the first releasable clamp means.

For a better understanding of the present invention, reference is had to an illustrative embodiment thereof which is represented in drawings in which.

Figure 10:
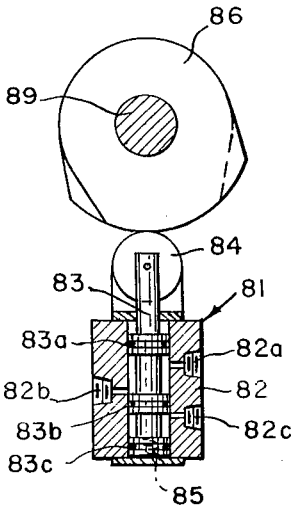
Figure 11:
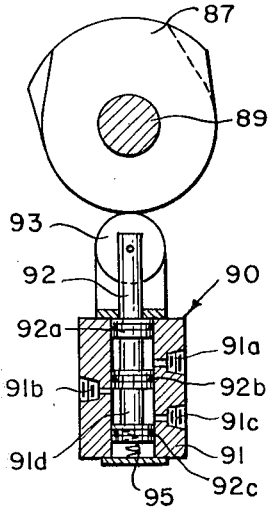
Figure 12:
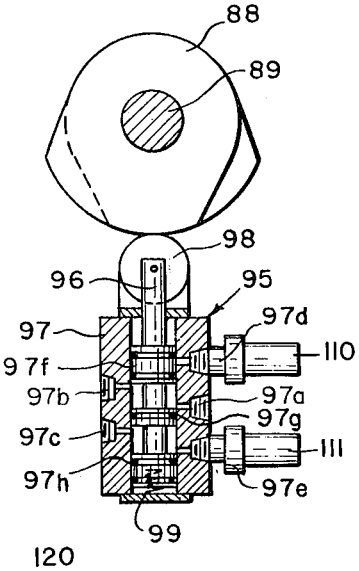
Figure 13:
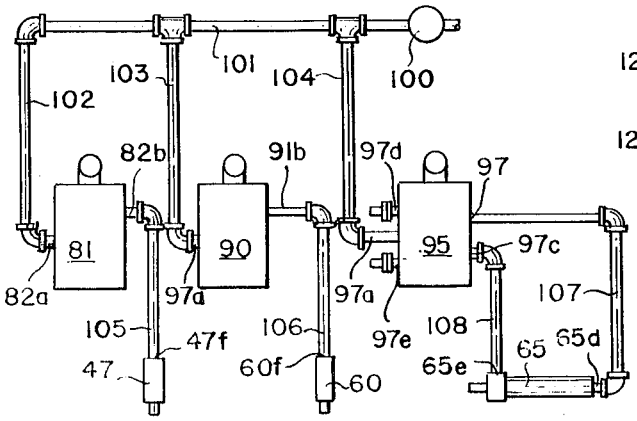
Figure 14:
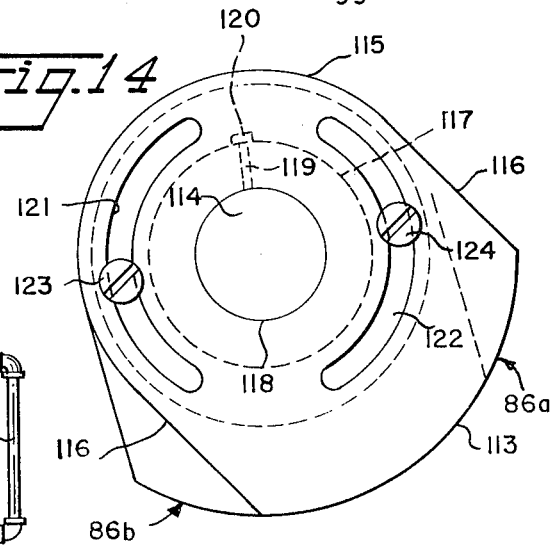

FIGS. 10, 11 and 12 present details of the cam and valve means referred to in the immediately preceding reference to figures of the drawing;

FIG. 13 represents a fluid system wherein the aforementioned valve means, and actuators controlled by those valves, are present; and FIG. 14 is representative of further details of the cam means.

Like reference numerals designate like components throughout the several figures of the drawing.

Figure 1:
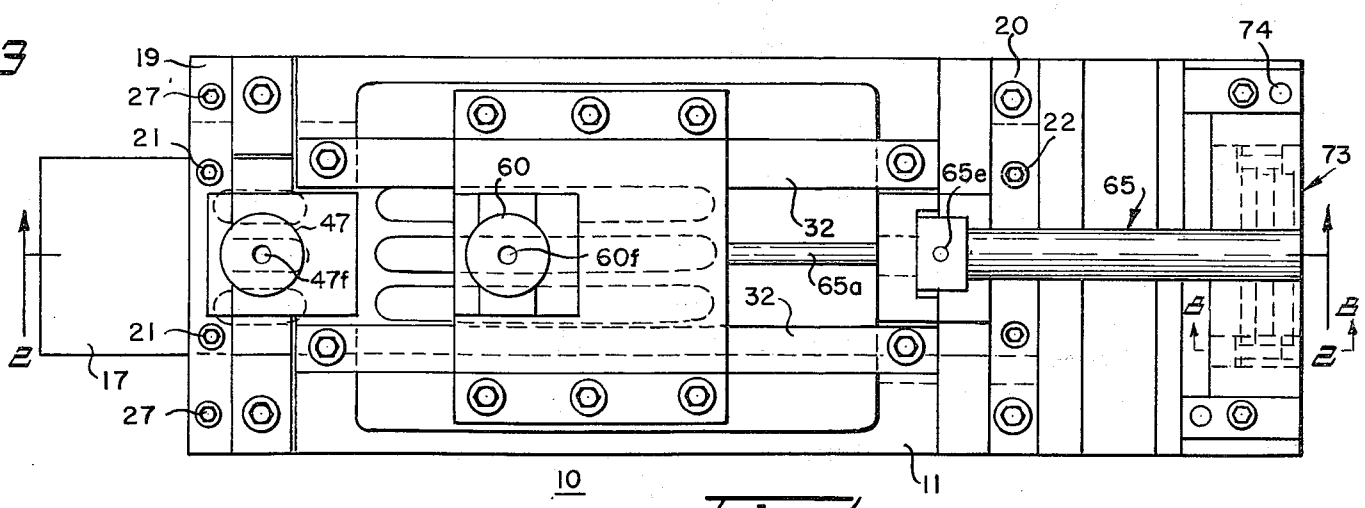
FIG. 1 is a top plan view of step-feed apparatus for step-feeding sheet material such as strip.
Figure 2:
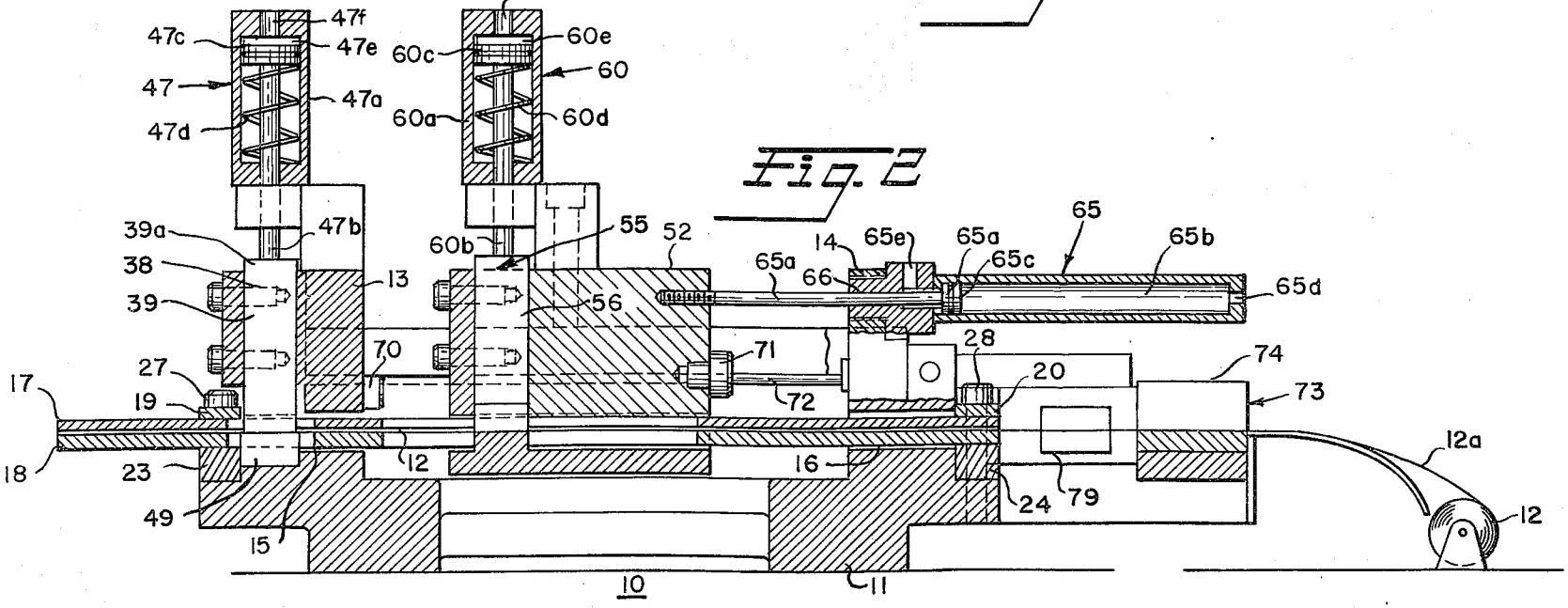
FIG. 2 is an elevational view, partially in section, taken along the line 2—2 in FIG. 1.
Figure 3:
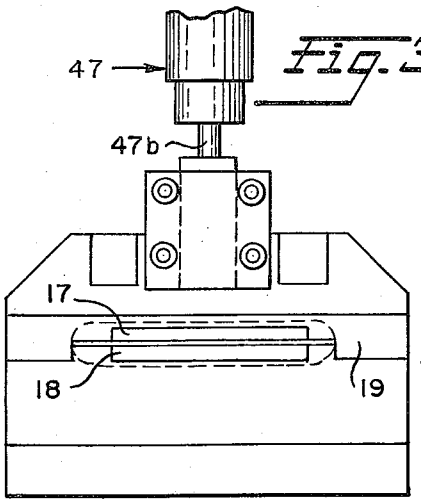
FIG. 3 is a front end elevation corresponding to FIGS. 1 and 2.
Figure 4:
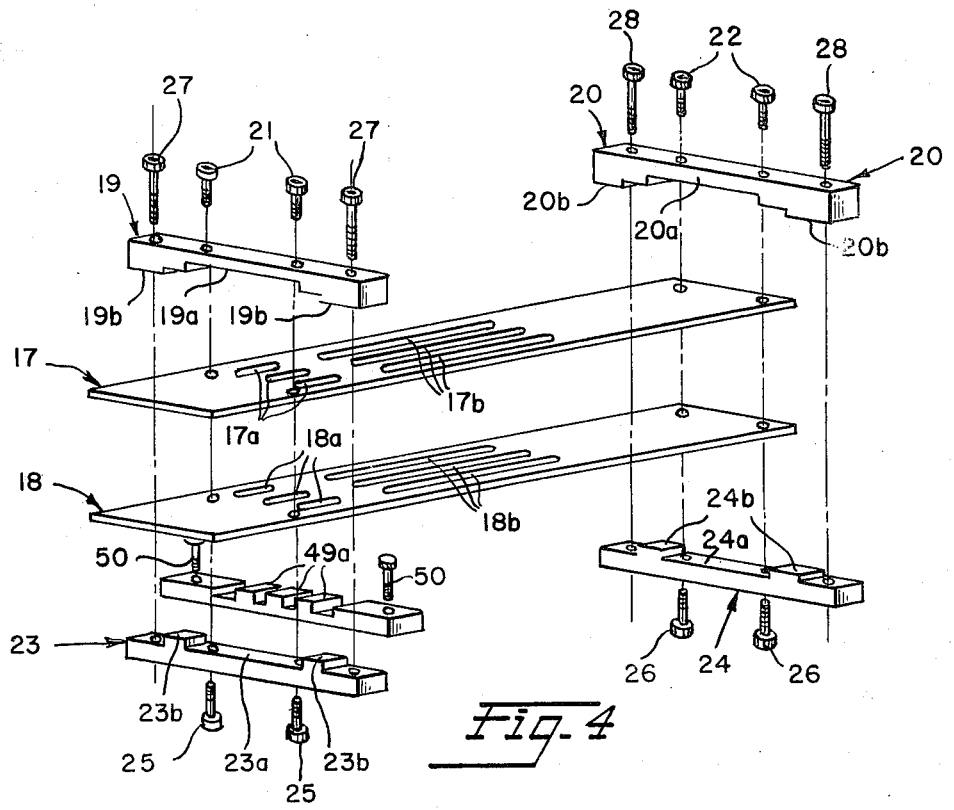
FIG. 4 is an exploded view representing retainer bar and guide plate details of the apparatus of the preceding figures of the drawing.

Referring now in particular to the illustrative embodiment of the present invention which is represented in the drawings herein, an apparatus for intermittently step-feeding sheet material is designated in general by the reference numeral 10 in FIGS. 1 and 2 and includes a support 11 having apertured forward and rearward uprights 13 and 14 from bed structure 11' interconnecting those uprights, which apertures 15 and 16 receive an upper guide plate 17 and a lower guide plate 18, and the upper guide plate 17 is secured adjacent to opposite longitudinal ends thereof to a forward upper retainer bar 19 and to a rearward upper retainer bar 20 by means of sets of machine screws 21 and 22, as will better be understood from FIG. 4, and the lower guide plate 18 is secured adjacent to opposite longitudinal ends thereof to a forward lower retainer bar 23 and to a rearward lower retainer bar 24 by means of sets of machine screws 25 and 26.

The upper retainer bars 19 and 20, being similar to one another, are laterally notched upwardly from the normally underneath side at 19*a* and 20*a*, respectively, on the width of the upper guide plate 17 and receive the latter plate in those notches, wherein securement to the upper retainer bars is had by means of the sets of machine screws 21 and 22. The notches 19*a* and 20*a* occur between pairs of legs 19*b* and 20*b* of the upper retainer bars 19 and 20 respectively.

Further, the forward and rearward lower retainer bars 23 and 24 also are similar to one another, and in this have normally upwardly extending pairs of projections 23*b* and 24*b*, respectively, marginally set in from the opposite longitudinal ends thereof and forming normally downwardly entrant lateral notches 23*a* and 24*a* with the bodies of the respective forward and rearward lower retainer bars on the width of the lower plate 18 to receive this plate secured by the sets of machine screws 25 and 26.

Inner faces of the pairs of legs 19*b* and 20*b* afforded by the forward and rearward upper retainer bars 19 and 20 are disposed respectively outside the pairs of projections 23*b* and 24*b* of the forward and rearward lower retainer bars 23 and 24, and the pairs of projections 23*b* and 24*b* vertically meet the forward and rearward upper retainer bars 19 and 20 to support the upper guide plate 17 directly over the lower guide plate 18, enabling the sets of machine screws 27 and 28 to be installed securing the forward upper and lower retainer bars 19 and 23 and the rearward upper and lower retainer bars 20 and 24 to the support 11, thereafter having the upper guide plate 17 disposed substantially parallel to the lower guide plate 18 and spaced upwardly from the lower guide plate. The upper and lower guide plates 17 and 18 accordingly are maintained in a parallel spaced apart relation to one another defining intermediately thereof a guide path 12 along which sheet material is to be fed while the sheet material is closely confined at its opposite faces by the adjacent faces of the guide plates 17 and 18.

Figure 6:
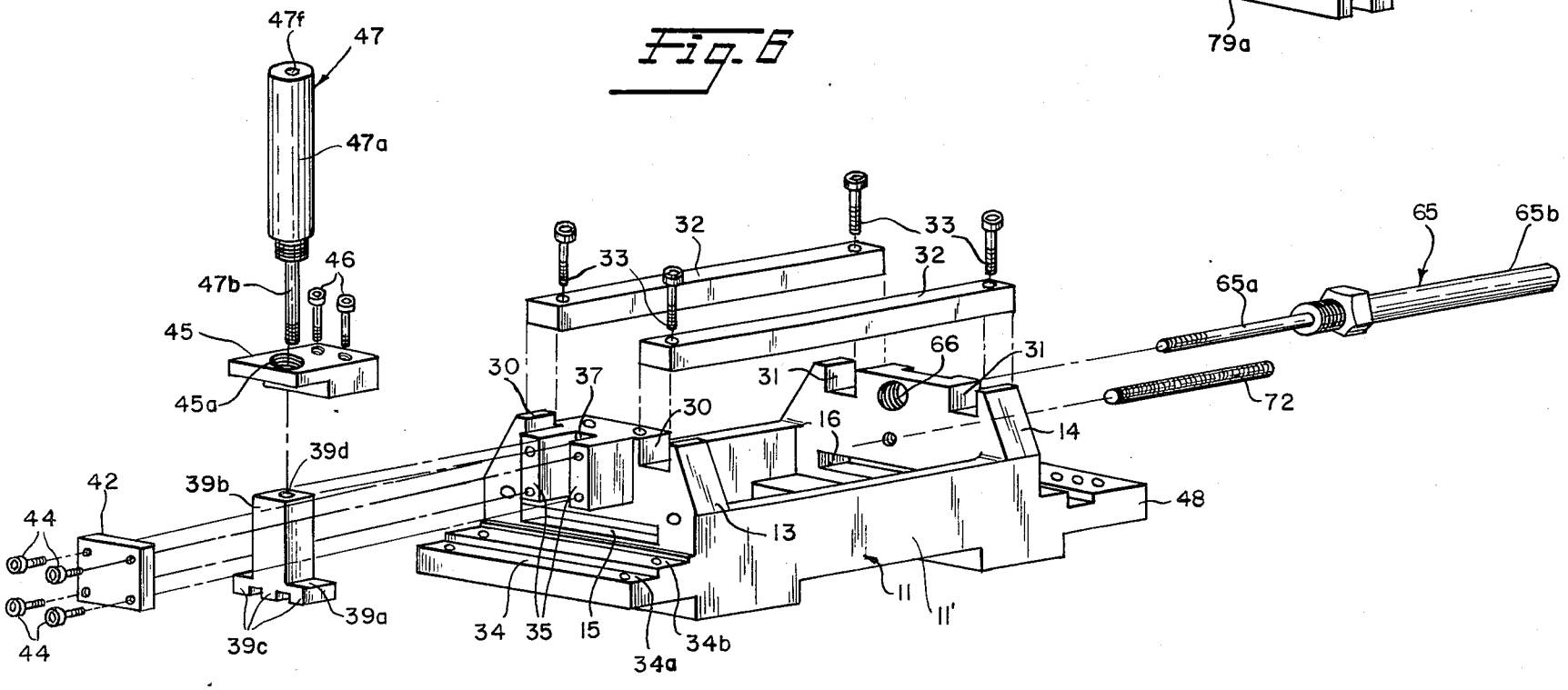
FIG. 6 is an exploded view showing details of forward clamp and anvil structure and related support means, guide rails, actuator and stroke adjusting structure.
Figure 8:
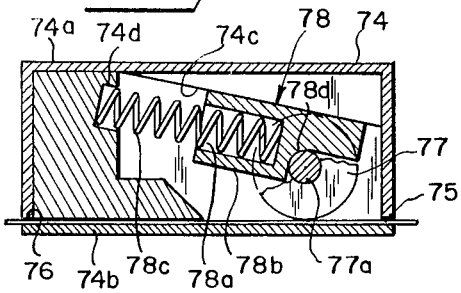
FIG. 8 is a sectional elevation taken along line 8—8 in FIG. 1.
Figure 9:
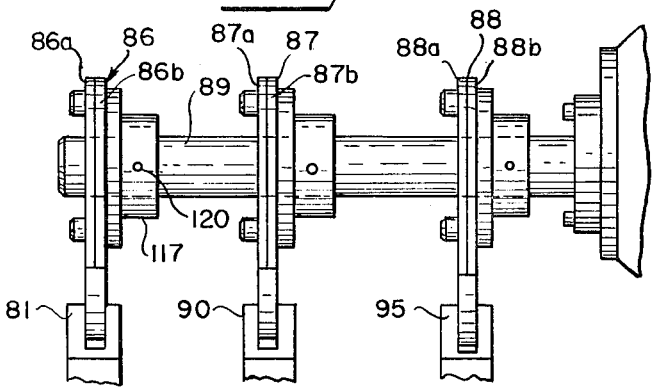
FIG. 9 is a side elevational view of cam shaft and cam means including fragmental representations of valve means thereby controlled.

A pair of rails 32 (see FIG. 6) which lead longitudinally of the support 11 are secured by means of machine screws 33 to the support with the rails being disposed in a pair of notches 30 in the upper end of the forward upright 13 and in a pair of notches 31 in the upper end of the rearward upright 14, and the rails 32 as disposed are substantially parallel to one another and furthermore lie in a plane which is substantially parallel to the plane of the guide path 12 formed between the upper and lower guide plates 17 and 18.

Forward extensions of the upper and lower guide plates 17 and 18 situated over a horizontal ledge 34 which is integral with the support 11 forwardly from the upright 13 and these same extensions of the upper and lower guide plates are situated underneath a pair of lugs 35 which are integral with upright 13 and form a longitudinally vertically leading channel with that upright. A movable portion 39 of a forward clamp 38 comprises a lower presser foot 39*a* and a rectangular member 39*b* which leads upwardly from that foot and into the vertical channel defined with lugs 35, for the movable portion 39 of clamp 38 to be free to be reciprocated while guided against the support 11 and against a cover plate 42 which is secured to the lugs 35 by means of a set of machine screws 44. A bracket 45 seated upon the upper end of the upright 13, and connected with that upright by machine screws 46, projects out over the upper end of the movable portion 39 of the clamp 38 with tolerance for portion 39 to be operated to and from clamping and release positions as will be more fully described hereinafter. The aforementioned projection of the bracket 45 is threaded within an aperture 45*a* which is aligned with an aperture 39*d* in the upper end of member 39*b* that is threaded in the latter aperture.

A power-driven actuator 47 includes a casing 47*a* threadedly engaged with the bracket 45 within the aperture 45*a*, and further includes a thrust rod 47*b* movably extending through the latter aperture and threadedly engaged in the aperture 39*d* within member 39*b* for moving with portion 39 of the clamp 38.

Ledge 34 forwardly of the upright 13 affords lower and upper steps 34*a* and 34*b*, respectively, the lower step 34*a* being forward in the apparatus from the upper step 34*b* and supporting the forward lower retainer bar 23 which is connected with the upper retainer bar 19 by the machine screws 27. Upper step 34*b* of the ledge supports a first anvil 49 which is secured thereto by machine screws 50, the anvil including three upward projections 49*a* (see FIG. 4) which register with a like number of apertures 18*a* in the lower guide plate 18 and project slightly upwardly of the top side of the lower guide plate 18 into the guide path 12 which is between plate 18 and the upper guide plate 17. The presser foot 39*a* of the forward clamp 38 furthermore includes three projections 39*c* (see FIG. 6) which register with three apertures 17*a* in the upper guide plate 17 for projections 39*c* to enter the aforementioned guide path 12 and be directly opposite the projections 49of the anvil 49 in that path, for clmaping sheet material in the guide path 12 to the anvil projections 49*a*.

Figure 5:
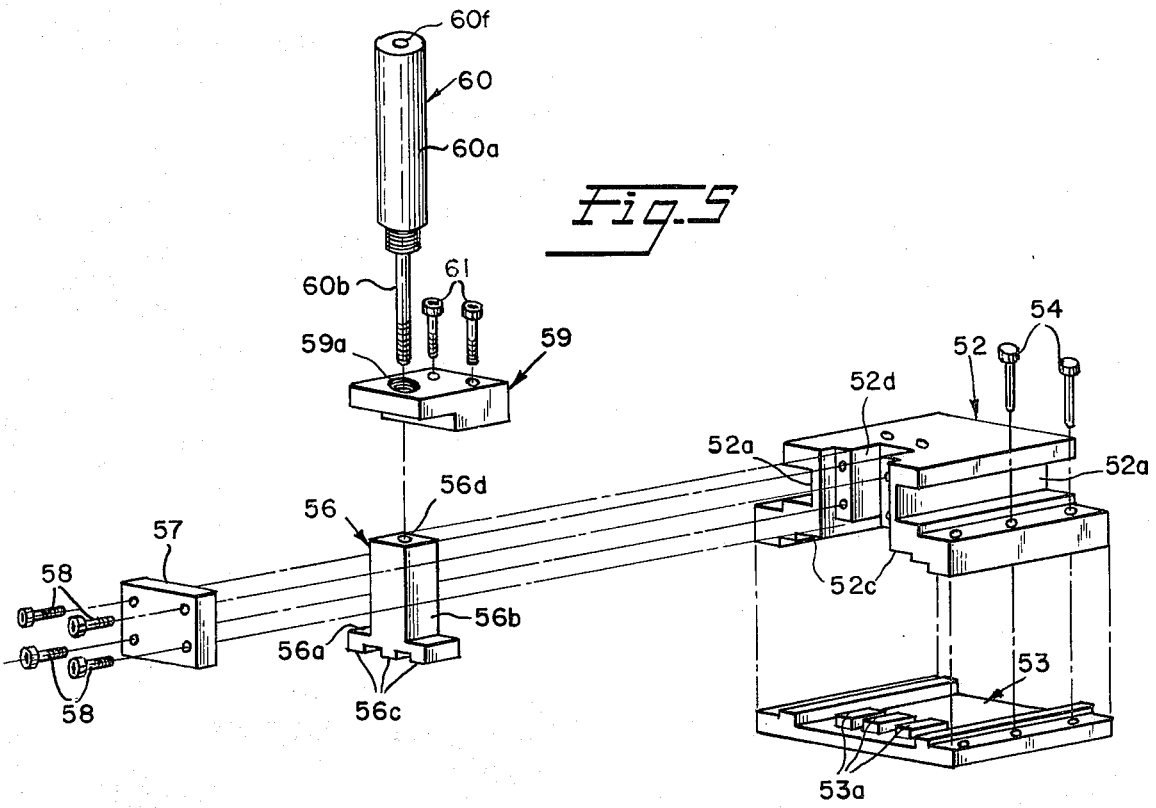
FIG. 5 is an exploded view presenting rearward clamp and anvil structure along with that of power-operated clamp means.

A feed block and rearward clamp support 52 is provided (see FIG. 5) having a pair of laterally oppositely entrant horizontal side channels 52*a* which receive the pair of rails 32 in a closely fitting slidable interrelation of the feed block and rearward clamp support with those rails for the rails to guide the feed block and rearward clamp support to be moved substantially parallel relatively to the upper and lower plates 17 and 18 intermediately of the forward and rearward uprights 13 and 14. The upper and lower plates 17 and 18 are accommodated within an inverted bottom horizontal channel 52*c* in the feed block and rearward clamp support 52, which bottom channel 52*c* is closed off by means of a second anvil which includes a plate 53 secured by a set of machine screws 54 to the feed block and rearward clamp support with the second anvil 53 being disposed underneath the guide plates 17 and 18 which lead through the bottom channel 52*c*. A forward vertical channel 52*d* also is defined by the feed block and rearward clamp support 52, and a movable portion 56 of a rearward clamp 55 comprises a lower presser foot 56*a* from which an integral rectangular member 56*b* leads upwardly within the channel 52*d*, for the movable portion 56 to be free to be reciprocated while guided against the channel 52*c* and against a cover plate 57 which is secured to the feed block and rearward clamp support 52 by machine screws 58. A bracket 59 is fastened to the top of the feed block and rearward clamp support by machine screws 61 and projects out over the movable portion 56 of the clamp 55 with there being tolerance for portion 56 to be operated to and from clamping and release positions. Further, the aforementioned projection of the bracket 59 is threaded within an aperture 59*a* which is aligned with an aperture 56*d* in the upper end of the rectangular member 56*b*, and the rectangular member is threaded in the latter aperture. A power-driven actuator 60 includes a casing 60*a* threadedly engaged with the bracket 59 within aperture 59*a* and further includes a thrust rod 60*b* movably extending through the latter aperture and threadedly engaged with aperture 56*d* with portion 56 of the rearward clamp 55 for moving with the latter portion.

In the upper guide plate 17, there is a set of slots 17*b* spaced laterally apart from one another and leading on their major dimensions longitudinally of the upper plate in a location rearwardly of the set of three apertures 17*a* which are in plate 17 and receive the projections 39*c* of the movable clamp portion 39. Directly opposing the slots 17*b* is a set of laterally spaced apart slots 18b in the lower guide plate 18 and the slots 18*b* accordingly lead longitudinally of the plate 18 on their major dimensions and are situated rearwardly of apertures 18*a* in the lower guide plate which receive the upward projections 49*a* of the first anvil 49. The second anvil 53 on the feed block and rearward clamp support 52 comprises a set of three upward projections 53*a* which lead through the slots 18*b* and terminate at upper ends slightly above the top face of the lower guide plate 18 and thus within the guide path 12 between the latter plate and the upper guide plate 17, and the slots 17 *b* in the upper guide plate are open to a set of three projections 56*c* of rearward clamp presser foot 56*a* which also enter the guide path 12 in a directly opposing relation to the anvil plate projections 53*a*.

A power-driven actuator 65 comprises a horizontal thrust rod 65*a* which extends through an opening 66 in the rear upright 14 of support 11 (see FIGS. 2 and 5) and is securely engaged with the feed block and clamp support 52 for transmitting thrust to the latter, and a casing 65*b* of the actuator 65 is secured to the upright 14 and extends rearwardly of that upright, enabling the feed block and clamp support 52 to be reciprocated under thrust received from the actuator rod 65*a*. A pair of bumpers 70 horizontally spaced apart from one another laterally of the support 11, and threadedly engaged with the forward upright 13, comprise abutments directed toward the forward longitudinal end of the feed block and rearward clamp support 52 for stopping movement of the feed block and rearward clamp support on the rails 32 on forward stroke of the actuator rod 65*a* while the downward projections 56*c* of the movable clamp portion 56 and the upward projections 53*a* of the second anvil 53 remain in alignment from set to set with one another through the upper and lower plate slots 17*b* and 18*b*. A rearward bumper means 71, threadedly engaged with the feed block and rearward clamp support 52, projects from the rearward longitudinal face of the latter, and a stroke-length adjusting screw 72 is threadedly engaged through the rearward upright 14 of the support 11 so as to present a longitudinal end contacting the bumper means 71, thus adjustably terminating rearward movement of the feed block and rearward clamp support 52 on the guide rails 32 while the downward projections 56*c* of the movable clamp portion 56 and the upward projections 53*a* of the second anvil 53 still remain in alignment from set to set with one another through the upper and lower plate slots 17*b* and 18*b*.

A one-way check assembly 73 forming a component of the sheet-feed apparatus 10 includes a casing 74, suitably fastened to the support 11 rearwardly of the upright 14 and having slit-like ingress and egress openings 75 and 76, respectively, therein for sheet material to pass through those openings and follow the guide path 12 between the upper and lower guide plates 17 and 18. A roller 77 within the casing 74 is provided with opposite stub ends 77*a* on the axis of the roller and the stub ends rest in notches 78*d* in adjacent ends of a corresponding pair of slides 78 which bear against a downwardly and rearwardly inclined face of wedge-like cam means 74*c* forming a portion of the top wall structure 74*a* of the casing 74. The slides 78 are biased to move with the roller 77 rearwardly by means of a pair of helical springs 78*c*, the rearward ends of the springs 78*c* being received in sockets 78*a* entrantly in the forward ends of the slides 78, and the forward ends of these same springs being seated within sockets 74*d* in the forward side wall structure of the casing 74. Compression in the springs 78*c* is sufficient to load the slides 78 rearwardly and downwardly on the cam means 74*c* for the slides by thrust upon the roller stub ends 77*a* to wedge the roller 77 against sheet material resting upon the bottom inner face 74*b* of the casing 74 and thereby prevent backward movement of the sheet material through openings 75 and 76.

Sheet material being fed forwardly in the apparatus 10 passes through the ingress opening 75 and the egress opening 76 and along the guide path 12 between the upper and lower plates 17 and 18, and passes between the roller 77 and the bottom inner face 74*b* of the casing 74, thereby carrying the roller 77 and slides 78 forwardly and upwardly against the bias of the springs 78*c*. Rearward movement of the sheet material, however, is immediately blocked by the roller 77 being wedged under bias of the springs 78*c* against the cam means 74*c* and against the sheet material which meanwhile is supported upon the bottom inner face 74*b* of the casing 74.

Figure 7:
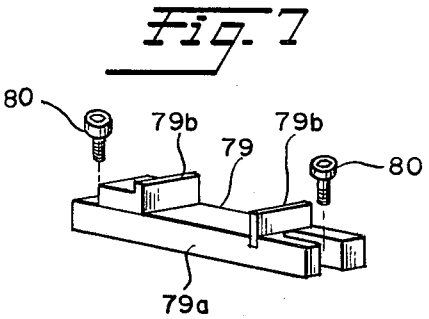
FIG. 7 is an isometric view representing sheet material aligning and guide means.

Intermediately of the one-way check assembly 73 and the upper and lower guide plates 17 and 18 the sheet feed apparatus 10 includes feed-aligning guide channel means 79 (see FIGS. 2 and 7) having a base 79*a* and two uprights 79*b* which are spaced laterally apart from one another a distance which is slightly greater than the width of the sheet material that is to be fed. Outside the two channel uprights 79*b* the base 79*a* is longitudinally notched at the ends and receives a pair of machine screws 80 in those notches securing the feed aligning guide channel means 79 laterally adjustably to the support 11. After backing off the machine screws 80, a desired alignment of the feed aligning guide channel means may be established with reference to the sheet egress opening 76 in the one-way check assembly 73 and with reference to the guide path 12 between the upper and lower guide plates 17 and 18, and is preserved by tightening the machine screws 80.

In the present embodiment, the power-driven actuators 47 and 60 are characterized respectively by the thrust rods 47*b* and 60*b* being connected with pistons 47*c* and 60*c* (see FIG. 2) within the casings 47*a* and 60*a*, and the thrust rod 47*b* and piston 47*c* and the thrust rod 60*b* and piston 60*c*, respectively, are biased to move upward by means of helical springs 47*d* and 60*d* pressing at one end against the down face of the related piston and at the other end against the up face of the related casing. Fluid chambers 47*e* and 60*e* are formed by the casings 47*a* and 60*a* and the pistons 47*c* and 60*c*, the chambers being in communication with ports 47*f* and 60*f* in the casings 47*a* and 60*a*. A control valve 81 (see FIG. 10 is provided having a casing 82 wherein a fluid supply port 82*a*, an operating port 82*b* and an exhaust port 82*c* communicate with a slide valve member 83 in the casing 82 for being controlled by the slide valve member. An end of the slide valve member 83 outside the casing 82 is equipped with a roller 84, and within the casing 82 a helical spring 85 is compressed pressing upon the inner end of the slide valve member and upon the inside of the casing for biasing the slide valve member to maintain contact with the edge of a first cam means 86 which is on the rotatable cam shaft 89 for rotating with the cam shaft.

A second cam means 87, which is also on the rotatable cam shaft 89 for rotating therewith (see FIG. 11) is utilized for controlling a valve 90 for the power-driven actuator 60. Valve 90 is similar to the control valve 81 and thus includes a casing 91 in which a fluid supply port 91*a*, an operating port 91b and an exhaust port 91*c* communicate with a slide valve member 92 for being controlled by that slide valve member. An end of the slide valve member outside the casing 91 is equipped with a roller 93 which is biased to press against the edge of the second cam means 87 by a helical spring 91*d* acting against the inner end of the slide valve member 92 and upon the inside of the casing.

Further in the present embodiment, the thrust rod 65*a* of the power driven actuator 65 is connected with a piston 65*c* which partitions off a pair of chambers 65*a* and 65*b* within the casing 65*b* and the chambers respectively communicate with fluid ports 65*e* and 65*d*.

A control valve 95 (see FIG. 12) for the power-driven actuator 65 comprises a slide valve member 96 and a casing 97, there being a fluid supply port 97*a*, a pair of operating fluid ports 97*b* and 97*c*, and a pair of exhaust ports 97*d* and 97*e* in the casing which are controlled by the slide valve member 96, the latter member having a roller 98 on an end thereof outside the casing 97. A helical spring 99 also forming a component of the control valve 95 bears at opposite ends inside the casing 97 upon the casing and upon the inner end of the slide valve member 96 and biases the latter member for the roller 98 to ride upon the edge of third cam means 88 which is on the rotatable cam shaft 89 for rotating therewith.

A source 100 of fluid, such as air, under pressure is connected with a header pipeline 101 which in turn is connected with branch pipes 102, 103, and 104 leading respectively to the fluid ports 82*a*, 91*a* and 97*a* of the control valves 81, 90 and 95, for the pressurized fluid to be conducted to those valves from the source 100 through the piping just mentioned. The slide 83 of valve 81 includes sealed lands 83*a*, 83*b* and 83*c* and similarly the slide 92 of the valve 90 comprises sealed lands 92*a*, 92*b* and 92*c*, and the operating ports 82*b* and 91*b* of the valves 81 and 90 communicate respectively with ports 47*f* and 60*f* in the actuators 47 and 60 through pipelines 105 and 106.

When the roller 84 and the related slide 83 takes a depressed position against the spring 85 under control of the cam means 86 communication is established for the pressurized fluid from port 82*a* to port 82*b* between lands 83*a* and 83*b* and through pipeline 105 and port 47f into the chamber 47*e* for driving the actuator piston 47*c* and rod 47*b* in opposition to the thrust of spring 47*d*, thus moving the presser foot 39*a* into clamping position against sheet material resting between the guide plates 17 and 18 upon the anvil 49. When the roller 84 and the related slide 83 under thrust of the spring 85 take an outer position under control of the cam means 86 fluid exhausts from the chamber 47*e* and port 47*f* and thence passes through the pipeline 105 and between lands 83*b* and 83*c* from port 82*b* to port 82*c*, allowing the spring 47d of actuator 47 in this same operation to raise the presser foot 39a to a released position with reference to the sheet material resting upon the anvil 49. Likewise, when the roller 93 and the related slide 92 take a depressed position against the spring 95 under control of the cam means 87 fluid courses under pressure between lands 92*a* and 92*b* from port 91*a* to port 91*b* and through pipeline 106 and port 60*f* into the chamber 60*e* for driving the actuator piston 60*c* and rod 60*b* in opposition to the thrust of spring 60*d*, thereby moving the pressure foot 56*a* into clamping position against sheet material resting between the guide plates 17 and 18 upon the anvil 53. With the roller 93 and related slide 92 taking an outer position under thrust of the spring 95 and control of the cam means 87, fluid exhausts from the chamber 60 *e* and port 60*e* and thence passes through the pipeline 106 and between lands 92*b* and 92*c* from port 91*b* to port 91*c*, allowing the spring 60*d* of actuator 60 in the same operation to raise the presser foot 56*a* to a released position with reference to the sheet material resting upon the anvil 53.

Pipelines 107 and 108, connected with the actuator 65 and valve 95, place the operating ports 97*b* and 97*c* in that valve in communication respectively with the actuator ports 65*d* and 65*e* for the piston 65*c* to be driven by fluid under pressure to effect either of opposite strokes under control of the cam means 88 and valve 95. When the valve slide 96, as urged against the cam means 88 by the spring 99, is brought on rotation of the cam means 88 with shaft 89 into a position wherein the inlet port 97*a* is open between the slide lands 97*f* and 97*g* to port 97*b*, fluid under pressure passes from port 97*a* through the valve to port 97*b* and thence through the pipeline 107 to the actuator port 65*d* for driving the piston 65*c* in a forward stroke, during which time ports 97*c* and 97*e* are open to one another between lands 97*g* and 97*h* for fluid to be exhausted from chamber 65*a* through part 65e of the actuator and through the pipeline 108 and the valve 95. When the valve 96, as urged by spring 99 against the cam means 88, is brought on rotation with the shaft 89 into a position wherein the inlet port 97*a* is open between the slide lands 97*g* and 97*h* to port 97*c*, fluid under pressure passes from port 97a through the valve to port 97c and thence through the pipeline 108 to the actuator port 65e for driving the piston 65e in a rearward stroke, this with having port 97b and port 97d open to one another between lands 97f and 97g for fluid to be exhausted from the chamber 65b through part 65d of the actuator and through the pipeline 107 and the valve 95.

A variable orifice metering valve 110 is connected with the exhaust port 97d and may be set to have any one of a number of different sizes of orifice for controlling the rate of movement of the actuator piston 65c while the latter is effecting a forward stroke, and also a variable orifice metering valve 111 is connected with the exhaust port 97e and may be set to have any one of sizes of orifice for controlling the rate of movement of the actuator piston 65c while the latter is effecting a backward stroke.

The cam means 86, 87 and 88 are angularly interrelated with one another on shaft 89 for controlling the valves 81, 90 and 95 while the shaft 89 is revolved in any suitable manner which in the present embodiment entails having the shaft 89 be an extension of, such as an attachment to, the ram control shaft of a power press, not shown, that is served sheet material 12a, such as strip, by the sheet feed apparatus 10 from the supply roll 12. Further, the angular interrelation of the cam means 86, 87 and 88 on the shaft 89 is in accordance with having the apparatus 10 step-feed the sheet material 12a forwardly at the proper interval corresponding to each forward step in the feed.

Let it be assumed for the moment that rod 65a and piston 65c of the actuator 65 are in backward end stroke position as prescribed by the cam means 88 and valve 95. In preparation for the next forward stroke of the piston 65c, continued angular movement of the cam means 87 with shaft 89 re-sets valve 90 for controlling the actuator 60 to move presser foot 56a for the presser foot projections 56c to clamp sheet material against the anvil plate projections 53a within the guide path 12 between plates 17 and 18. Meanwhile, the cam means 86 controls the valve 81 and actuator 47 for presser foot 39a to remain released from the sheet material in the region of anvil 49. Under these same conditions, but with continued angular movement of shaft 89, the cam means 88 controls valve 95 and actuator 65 for the piston 65c to move forwardly in response to the pressure of fluid in chamber 65b, during which time the rod 65a and the feed block and rearward clamp support 52 move forwardly having the latter guidedly following the rails 32 and carrying the rearward clamp 55 and the anvil 53 while the three downward projections 56c of the presser foot 56a and the three upward projections 53a of the anvil 53, being in and following the guide plate slots 17b and 18b, respectively, clamp the sheet material and move with the same within the guide path between the plates 17 and 18, as permitted by the one-way check assembly 73, until the movement is stopped by contact of the feed block and rearward clamp support 52 with the pair of bumpers 70 on the forward mount upright 13. Thereafter, continued angular movement of the shaft 89 with the cam means 86, 87 and 88 causes the valve 81 to re-set and control the actuator 47 for applying the presser foot projections 39c through apertures 17a in the guide plate 17 for those projections to press the sheet material in the guide path upon the projections 49a of the anvil 49 which project into the guide path 12 through the apertures 18a in plate 18, thus firmly clamping the sheet material under pressure of fluid in the actuator chamber 47e. Subsequently, the cam means 87 causes the valve 90 to re-set and control the actuator 60 to release the presser foot projections 56c from the sheet material opposite the anvil projections 53a under force of the spring 60a, and this is followed by a backward stroke of the feed block and rearward clamp support 52 on the rails 32 in response to fluid pressure in chamber 65a of the actuator 65, as prescribed by valve 95 under control of the cam means 88, the backward movement being accompanied by having the presser foot projections 39a hold the sheet material clamped to the anvil projections 49a while the pressure foot projections 56c and anvil projections 53a move relatively to the sheet material rearwardly with the feed block and rearward clamp support 52 along the slots 17b and 18b until rearward stroke of the feed block and rearward clamp support, and accordingly that of the actuator piston 65c, is arrested by the stroke adjusting screw 72, for the sheet material thereafter to be subjected to a further forward feeding step, during which the hereinbefore described cycle of the cam means 86, 87 and 88 for controlling the valves 81, 90 and 95, and accordingly the operation of the actuators 47, 60 and 65 is repeated.

Each of the cam means 86, 87 and 88 includes a cylindrical hub and a pair of overlapping arcuate plate sectors on the shaft 89, the hub being adjustably secured to the latter shaft and the cam sectors in the pair being adjustably secured together and to the hub by means of set screws in order that the control cycle of the cam means 86, 87 and 88 can be altered such as to comply with a change in timing operations introduced in a machine, or by different machines, any of which the apparatus 10 is called upon to serve without replacement of the cam means 86, 87 and 88.

Since the structure from cam means to cam means in the present embodiment is similar, it is believed that a description of the cam plate sector and hub structure of the cam means 86 will suffice for an understanding also of the structure of each of the cam means 87 and 88. Thus, cam means 86 includes the cam plate sectors 86a and 86b which are themselves similar to one another, each having an outermost approximately 90-° arcuate edge portion 113 on a major radius from the center of an opening 114 for the shaft 89, and further having an approximately 180-° arcuate edge portion 115 on a minor radius also from the center of opening 114, and there are substantially straight edge portions 116 of the sector joining the ends of the edge portions 113 and 115 and extending substantially parallel to a straight line which bisects the two arcuate edge portions 113 and 115. The cylindrical hub 117 of the cam means 86 has a central longitudinal opening 118 which is coaxial with the central openings 114 of the sectors 86a and 86b, and a radial opening 119, for the central hub opening 118 to receive snugly the shaft 89 and the radial opening 119 threadedly to receive a set screw 120 and the set screw to be tightened to secure the hub to the shaft. A pair of approximately 120° arcuate slots 121 and 122 in each of the sectors 86a and 86b are on a radius from the center of opening 114 in the sector and are substantially bisected by a straight line drawn from the intersection of one end of the arcuate edge portion 113 with one of the straight edge portions 116 and through the center of the related sector opening 114. Set screws 123 and 124 leading through the slots 121 and 122 in each of the sectors 86*a* and 86*b* are threadedly engaged with a longitudinal end of the hub 177 and adjustably secure those sectors to the hub. Since the cam means 87 and 88 respectively include a hub and cam sectors 87*a* and 87*b*, and a hub and cam sectors 88*a* and 88*b* similar to the hub 117 and sectors 86*a* and 86*b* of the cam means 86, and are attached in a manner similar to the connections in that respect described for the cam means 86, further details in that respect are thought to be unnecessary.

It will be observed that by backing off the radial screw 120 in the hub 117 of the cam means 86, the angular position of the latter cam means may be altered on the shaft 89 with reference to the cam means 87 and 88, and that the latter two means may also be angularly adjusted when their hub screws are released from the shaft. Further, it will be seen that by backing off the set screws 123 and 124 in the cam means 86, the cam sectors 86*a* and 86*b* may be altered in angular position relatively to one another on the shaft 89, thus altering the effective arcuate length of the arcuate edges 113 and 115. Likewise, the effective arcurate lengths of the sectors in the cam means 87 and 88 may also be adjusted.

As the invention lends itself to many possible changes and as many possible changes may be made in the embodiment hereinbefore described, it will be distinctly understood that all matter described herein is to be interpreted as illustrative and not as a limitation.

We Claim:

1. Apparatus for step-feeding sheet material, said apparatus including: guideway and first anvil means comprising a pair of opposed guide plate means for constraining sheet material against buckling of the latter when sheet material is disposed in a guide path between said pair of opposed guide plate means and is fed along said guide path, said pair of guide plate means each having a set of slots therein and said slots in said sets longitudinally leading along said guide in and being spaced apart from one another in said set laterally of said guide path, and first anvil means disposed along said guide path forwardly of said sets of slots and accessibly opposite apertured structure of one of said pair of opposed guide wall means; power-operated first clamp means comprising driven first presser means projecting through said apertured structure of said one of said pair of opposed guide plate means for clamping sheet material in said guide path against said first anvil means and for releasing sheet material from said presser anvil means; guide means; guide follower, second anvil and power-operated second clamp means comprising, second anvil means, power-operated second clamp means, and follower means on said guide means for carrying said second anvil means and said power-operated second clamp means forwardly toward said first anvil means and said first presser means, and rearwardly, said second anvil means having a set of projections extending through said set of slots in a first of said pair of opposed plate means slightly into said guide path, and said power-operated second clamp means including driven second presser means, said second presser means having a set of projections aligned with said set of slots in the other of said pair of opposed guide plate means for clamping sheet material in said guide path against said set of projections of said second anvil means and for releasing sheet material from said second anvil means, and said follower means carrying said second anvil means and said power-operated second clamp means for sheet material clamped against said second anvil means by said second presser means to be forwardly fed having said set of projections of said second anvil means and said set of projections of said second presser means follow said sets of slots in said pair of opposed guide plate means; power-operated drive means connected with said guide follower, second anvil and power-operated second clamp means for moving said follower means to and from forward and rearward positions along said guide means and to carry said second anvil means and said power-operated second clamp means; and means for controlling said power-operated drive means and said power-operated first and second clamp means to step-feed sheet material forwardly along said guide path.

2. Apparatus for step-feeding sheet material as set forth in claim 1 wherein said first anvil means, in being accessible in said guide path to said first presser means through said apertured structure of said one of said pair of opposed guide plate means, includes projecting means for said projecting means to support sheet material slightly away from the other of said pair of opposed guide plate means, and said first presser means movably opposes said projecting means through said apertured wall structure of said one of said pair of opposed guide plate means for said first presser means to clamp sheet material against said projecting means in said guide path and release sheet material from said projecting means.

3. Apparatus for step-feeding sheet material as set forth in claim 1 wherein said apertured wall structure of said one of said pair of opposed guide plate means is characterized by having a set of apertures therein and said apertures spaced laterally of said guide path from one another, and said first presser means includes a plurality of projections extending through said apertures and movable for clamping sheet material in said guide path against said first anvil means and releasing sheet material from said first anvil means.

4. Apparatus for step-feeding sheet material as set forth in claim 1 wherein said first anvil means, in being accessible in said guide path to said first presser means through apertured structure of said one of said pair of opposed guide plate means, includes means projecting through apertured wall structure of the other of said pair of opposed guide plate means for supporting sheet material slightly away from said other of said pair of guide plate means, and said first presser means movably opposes said projecting means through said apertured wall structure of said one of guide plate means for said first presser means to clamp sheet material against said projecting means in said guide path and release sheet material from said projecting means.

5. Apparatus for step-feeding sheet material as set forth in claim 1 wherein said first anvil means, in being accessible in said guide path to said first presser means through apertured structure of said one of said pair of opposed guide plate means, includes a plurality of projections spaced from one another laterally of said guide path for supporting sheet material slightly away from the other of said pair of opposed guide plate means, and said first presser means movably opposes said plurality of projections of said first anvil means through said apertured wall structure of said one of said pair of opposed plate means for said first presser means to clamp sheet material against said projections of said first anvil means in said guide path and release sheet material from said projections of said first anvil means.

6. Apparatus for step-feeding sheet material as set forth in claim 1 wherein said first anvil means, in being accessible in said guide path to said first presser means through apertured structure of said one of said pair of opposed guide plate means, includes a plurality of projections spaced from one another laterally of said guide path and projecting through apertured wall structure of the other of said pair of opposed guide plate means for supporting sheet material slightly away from said other of said pair of opposed guide plate means in said guide path, and a plurality of projections of said first presser means movably oppose said projections of said first anvil means through said apertured wall structure of said one of said pair of opposed guide plate means to clamp sheet material against said projections of said first anvil means and to release sheet material from said projections of said first anvil means.

7. Apparatus for step-feeding sheet material as set forth in claim 6 wherein said pair of opposed guide plate means sets of apertures therein, said apertures being spaced laterally of said guide path from one another in said sets, and said projections of said first anvil means extend through one of said sets of apertures of said projections of said first presser means extend through the other of said apertures and are opposed.

8. Apparatus for step-feeding sheet material, said apparatus including: support means comprising bed means and forward and rearward upright means interconnected by said bed means, said forward and rearward upright means having openings therein; guideway and first anvil means including a pair of opposed guide plate means extending outside said bed means and through said openings in said forward and rearward upright means for sheet material longitudinally to be fed along a guide path leading through said forward and rearward uprights and intermediately of said pair of opposed guide plate means and be constrained against buckling in said guide path by said pair of opposed guide plate means, and first anvil means disposed along said guide path forwardly of said forward upright means, said pair of opposed guide plate means having rearward open structural portions between said forward and rearward upright means, and one of said pair of opposed guide plate means having a forward open structural portion disposed forwardly of said forward upright means and opposite said first anvil means; power-operated first clamp means connected with said forward upright means and comprising driven first presser means projecting through said open forward structural portion of said one of said pair of opposed guide plate means for clamping sheet material in said guide path against said first anvil means and for releasing sheet material from said first anvil means; guide means bridging across said forward and rearward upright means; guide follower, second anvil and power-operated second clamp means including, second anvil means, power-operated second clamp means, and follower means on said guide means for carrying said second anvil means and said power-operated second clamp means forwardly and rearwardly between said forward and rearward upright means, said second anvil means extending through said open rearward structural portion of a first of said pair of opposed guide plate means slightly into said guide path, and said power-operated second clamp means including driven second presser means extending aligned through said open rearward structural portion of the second of said pair of opposed guide plate means, for said second presser means to clamp sheet material in said guide path against said second anvil means and release sheet material from said second anvil means, and said follower means carrying said second anvil means and said power-operated second clamp means for sheet material clamped against said second anvil means by said second presser means to be forwardly fed having said second anvil means and said second presser means travel extending through said open rearward structural portions of said pair of opposed guide plate means; power-operated drive means supported on said rearward upright means and connected with said guide follower, second anvil and power-operated second clamp means for moving said follower means along said guide means to and from forward and rearward positions between said forward and rearward upright means and to have said follower means carry said second anvil means and said power-operated second clamp means; and means for controlling said power-operated drive means and said power-operated first and second clamp means to step-feed sheet material forwardly along said guide path.

9. Apparatus for step-feeding sheet material as set forth in claim 8 wherein said open rearward structural portions of said first and second opposed guide plate means each include a set of slots therein and said slots in said sets longitudinally lead along said guide path between said forward and rearward upright means and are spaced apart from one another in said set laterally of said guide path, said second anvil means includes a set of projections extending through said set of slots in said first guide plate means slightly into said guide path, and said second presser means includes a set of projections aligned with said set of projections of said second anvil means through said set of slots in said second guide plate means for clamping sheet material against said set of projections of said anvil means and releasing sheet material from said second anvil means.

10. Apparatus for step-feeding sheet material as set forth in claim 9 wherein said first anvil means includes projecting means for said projecting means to support sheet material slightly away from said first guide plate means in said guide path opposite said first presser means.

11. Apparatus for step-feeding sheet material as set forth in claim 9 wherein said first anvil means includes a plurality of projections spaced from one another laterally of said guide path for said projections to support sheet material slightly away from said first guide plate means in said guide path, and said first presser means includes a set of projections through apertures in said second guide plate means for said set of projections of said first presser means to clamp sheet material in said guide path against said projections of said first anvil means and release sheet material from said anvil means.

* * * * *